US008665421B1

(12) United States Patent
Owen, III et al.

(10) Patent No.: US 8,665,421 B1
(45) Date of Patent: Mar. 4, 2014

(54) APPARATUS FOR PROVIDING LASER COUNTERMEASURES TO HEAT-SEEKING MISSILES

(75) Inventors: Joseph M. Owen, III, Derry, NH (US); Peter Russo, Nashua, NH (US); Jeffrey Minch, Nashua, NH (US); Kevin Larochelle, Goffstown, NH (US); Kenneth Dinndorf, Bedford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 299 days.

(21) Appl. No.: 12/762,860

(22) Filed: Apr. 19, 2010

(51) Int. Cl.
*G01S 17/10* (2006.01)

(52) U.S. Cl.
USPC ..... 356/5.01; 342/14

(58) Field of Classification Search
USPC ..... 356/5.01; 342/14
See application file for complete search history.

(56) References Cited

U.S. PATENT DOCUMENTS

| | | | | |
|---|---|---|---|---|
| 5,373,182 | A * | 12/1994 | Norton | 257/440 |
| 5,600,434 | A * | 2/1997 | Warm et al. | 356/139.08 |
| 5,662,291 | A * | 9/1997 | Sepp et al. | 244/3.13 |
| 6,021,975 | A * | 2/2000 | Livingston | 244/3.11 |
| 6,864,965 | B2 * | 3/2005 | DeFlumere | 356/4.01 |
| 6,952,010 | B2 * | 10/2005 | Nizani | 250/236 |
| 7,378,626 | B2 | 5/2008 | Fetterly | |
| 7,429,734 | B1 * | 9/2008 | Tidwell | 250/338.1 |
| 7,492,308 | B2 * | 2/2009 | Benayahu et al. | 342/52 |
| 7,899,644 | B2 * | 3/2011 | Weber et al. | 702/134 |
| 7,952,688 | B2 * | 5/2011 | Paiva et al. | 356/4.01 |
| 2008/0088496 | A1 | 4/2008 | Thum-Jaeger et al. | |
| 2009/0121925 | A1 * | 5/2009 | Scott et al. | 342/195 |

* cited by examiner

*Primary Examiner* — Isam Alsomiri
*Assistant Examiner* — Vicente Rodriguez
(74) *Attorney, Agent, or Firm* — Daniel J. Long

(57) ABSTRACT

A laser-based infrared countermeasure (IRCM) system is disclosed. The IRCM system includes a set of receive optics, a dichroic filter, first and second detectors, a lens module and a laser. Receive optics are configured to receive optical information. The lens module reflects the optical information from the receive optics to the dichroic filter. The dichroic filter selectively splits the optical information to the first and second detectors. The first and second detectors, each of which is formed by a single-pixel detector, detects a potential missile threat from the optical information. Based on information collected by the first and second detectors, the laser sends laser beams to neutralize any missile threat.

24 Claims, 3 Drawing Sheets

APPARATUS FOR PROVIDING LASER COUNTERMEASURES TO HEAT-SEEKING MISSILES

The present invention was made with United States Government support under Contract number N00173-05-C-6020. The Government has certain rights in the present invention.

BACKGROUND OF THE INVENTION

1. Technical Field

The present invention relates to countermeasures for heat-seeking missiles in general, and in particular to an apparatus for providing laser countermeasures to missiles launched against airborne helicopters and aircraft.

2. Description of Related Art

Advanced Man-Portable Air Defense Systems (MANPADS) present a significant threat to airborne fixed-wing aircraft and helicopters. Several existing Missile Warning Systems (MWS), including the Common Missile Warning System (CMWS), are capable of detecting and reporting missile threats with high detection confidence. In addition, laser-based infrared countermeasure (IRCM) systems can also provide the needed protection from MANPADS for many types of aircraft.

However, the coarse angular tracking capabilities of MWSs are insufficient for directed employment of IRCMs. As a result, conventional IRCM architectures have to reply on secondary tracking systems that employ cryo-cooled infrared focal planes and large gimbals, which substantially increases system cost and mass. In addition, conventional IRCM systems tend to have complex pointer/tracker-turret assemblies that are typically very expensive. Thus, the cost and mass of conventional IRCM systems have been too prohibitively high to be implemented for all but a few selected number of high-value aircraft.

Consequently, it would be desirable to provide an improved IRCM system that is more cost effective.

SUMMARY OF THE INVENTION

In accordance with a preferred embodiment of the present invention, a laser-based infrared countermeasure system includes a set of receive optics, a dichroic filter, first and second detectors, a lens module and a laser. Receive optics are configured to receive optical information. The lens module reflects the optical information from the receive optics to the dichroic filter. The dichroic filter selectively splits the optical information to the first and second detectors. The first and second detectors, each of which is formed by a single-pixel detector, detects a potential missile threat from the optical information. Based on information collected by the first and second detectors, the laser sends laser beams to neutralize any missile threat.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
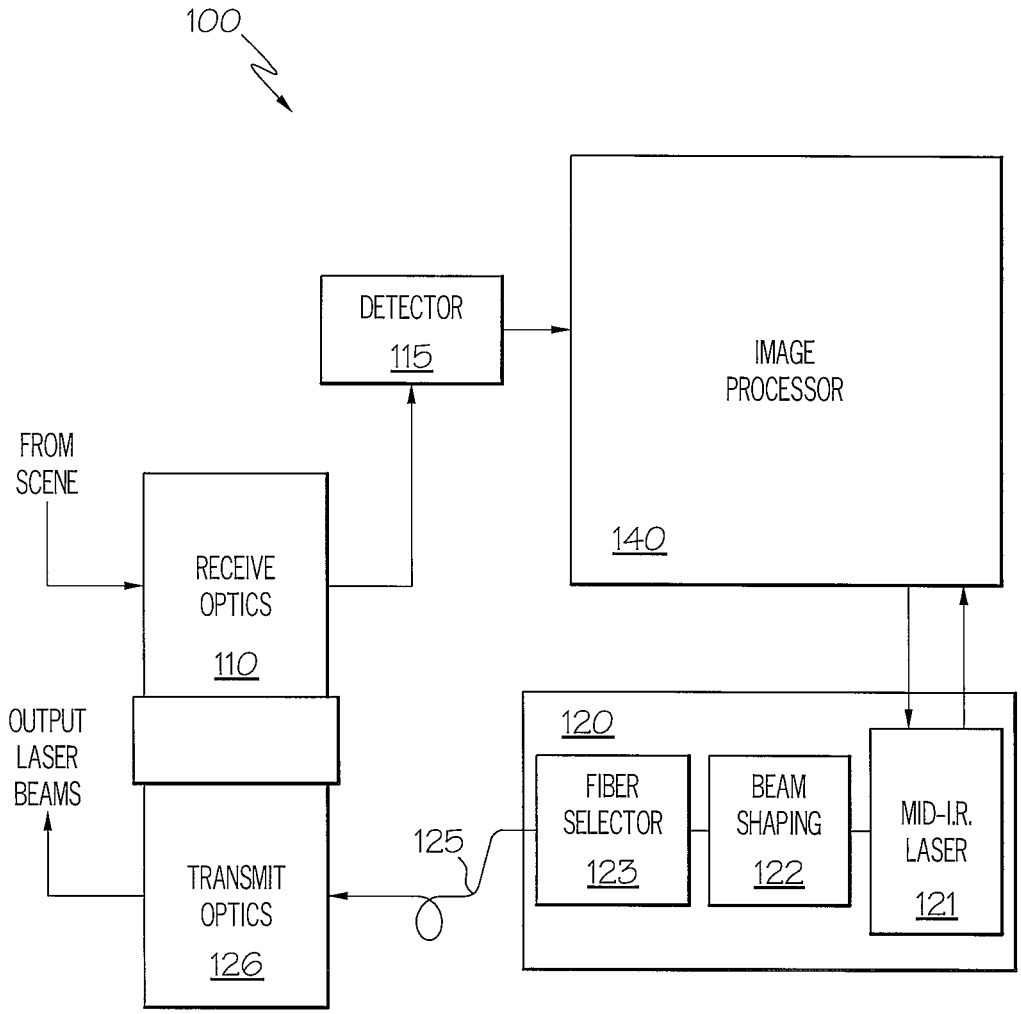
FIG. 1 is a block diagram of an infrared countermeasure system, in accordance with a preferred embodiment of the present invention.

Referring now to the drawings and in particular to FIG. 1, there is illustrated a block diagram of an infrared countermeasure (IRCM) system, in accordance with a preferred embodiment of the present invention. As shown, an IRCM system 100 includes a set of receive optics 110, a detector 115, an image processor 140, a laser-pointer unit 120, and a set of transmit optics 126. Receive optics 110 point to various directions in order to obtain image data from different parts of the environment. The collected image data are then sent to a detector 115. Detector 115 may be formed by multiple detectors as will be explained later in details.

After receiving pertinent optical information from detector 115, image processor 140 maps all targets of interest and prioritizes the target information based on respective intensities. Image processor 140 also provides active interrogations on the optical information to determine whether or not there is a real threat.

When a real threat, such as an incoming heat-seeking missile, is confirmed, image processor 140 activates laser-pointer unit 120 to send laser beams from transmit optics 126 to neutralize the threat. Image processor 140 provides modulation control and direction control to laser-pointer unit 120 for laser beam emissions.

Laser-pointer unit 120 includes a mid-infrared laser 121, beam-shaping optics 122 and a fiber selector 123. A laser beam is directed into the end of one of the fibers within a fiber bundle 125. Fiber bundle 125 is routed along or through the platform to transmit optics 126. The far ends of fiber bundle 125 and transmit optics 126 are configured to form output laser beams in various directions.

Figure 2:
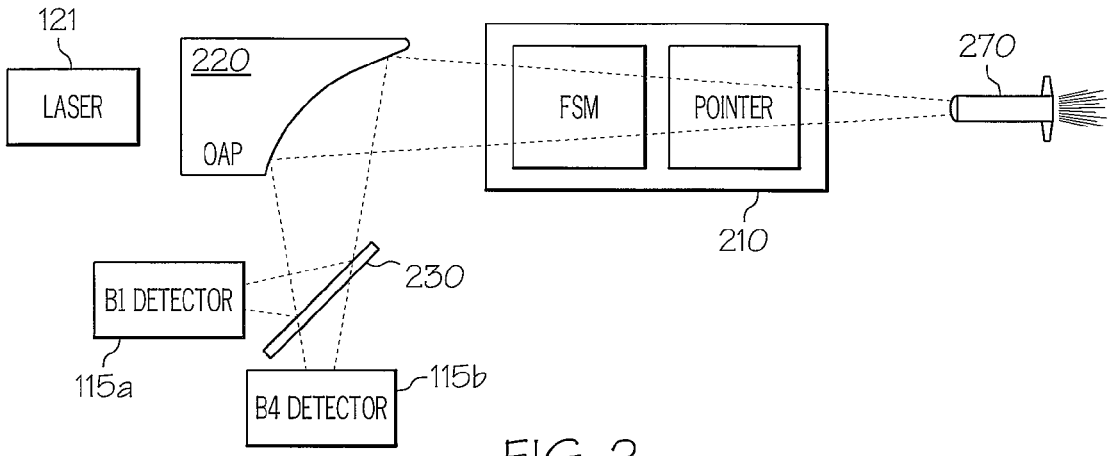
FIG. 2 is a block diagram of the optical components of the infrared countermeasure system from FIG. 1, in accordance with a preferred embodiment of the present invention.

With reference now to FIG. 2, there is depicted a block diagram of the optical components within IRCM system 100 from FIG. 1, in accordance with a preferred embodiment of the present invention. As shown, the optical components includes an optical tracking module 210, a lens module 220, a dichroic filter 230, a band 1 detector 115*a* and a band 4 detector 115*b*. Optical tracking module 210, which includes a pointer and a set of fast-steering mirrors, is configured for detecting any incoming missile such as a missile 270. Lens module 220 directs the optical information obtained by optical tracking module 210 to dichroic filter 230. In turn, dichroic filter 230 selectively splits and sends the appropriate optical information to band 1 detector 115*a* and band 4 detector 115*b* accordingly. Based on the information collected by band 1 detector 115*a* and band 4 detector 115*b*, laser 121 may send laser beams to neutralize missile 270.

For the present embodiment, band 1 detector 115*a* detects optical information of approximately 2 micron wavelength, and band 4 detector 115*b* detects optical information of approximately 4 micron wavelength. Lens module 220 is preferably an off-axis paraboloid lens.

In accordance with a preferred embodiment of the present invention, each of band 1 detector 115*a* and band 4 detector

Figure 3:
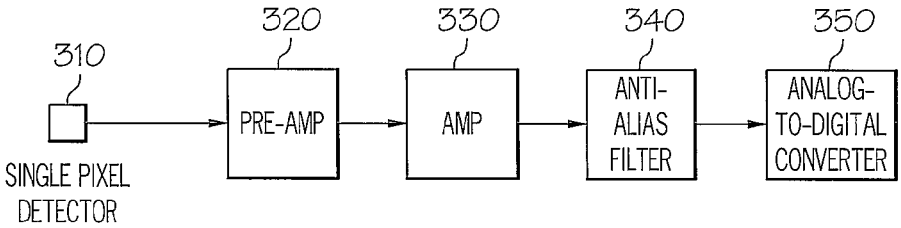
FIG. 3 illustrates a single-pixel detector, in accordance with a preferred embodiment of the present invention.

115*b* is made up of a single-pixel detector, such as a single-pixel detector 310, as shown in FIG. 3. The information collected by single-pixel detector 310 are sent to a pre-amplifier 320, an amplifier 330, an anti-alias filter 340 and an analog-to-digital converter 350. Image processor 140 (from FIG. 1) performs match filtering on the laser pulses information from analog-to-digital converter 350.

The output bandwidth of detector 310 is preferably greater than 40 MHz, and is Nyquist-sampled (greater than $8^7$ samples per second). Basically, the output bandwidth of single-pixel detector 310 must be high enough to resolve individual laser pulses with high fidelity. To maximize compatibility across a wide variety of lasers, a higher bandwidth (>40 MHz for example) is preferred.

Figure 4:
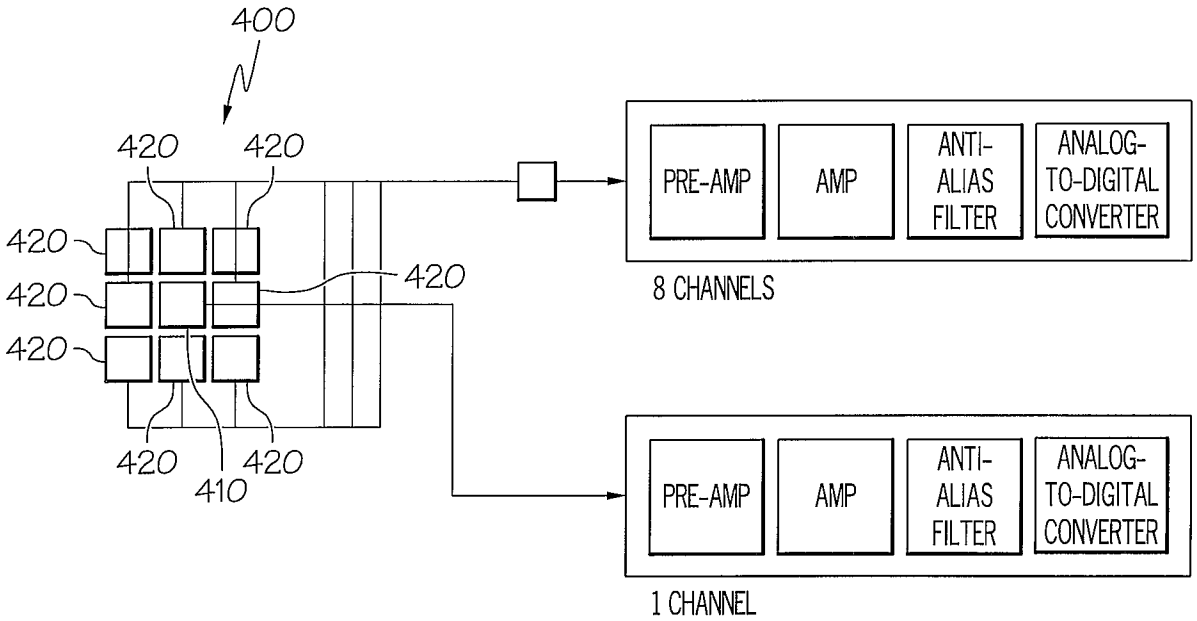
FIG. 4 illustrates a multi-pixel detector, in accordance with a preferred embodiment of the present invention.

The single-pixel detector approach has the lowest bandwidth requirement, but its tradeoffs are longer timelines and reduced target tracking capabilities. As a modification, the single-pixel detector approach can be augmented by adding a few more detectors to form a multi-pixel detector module, as depicted in FIG. 4. As shown, a multi-pixel detector module 400 includes one high-speed single-pixel detector 410 surrounded by eight low-speed single-pixel detectors 420. With the 3×3-pixel detector configuration, the eight low-speed single-pixel detectors 420 operate at a relatively low bandwidth intended for passive detection. High-speed single-pixel detector 410, on the other hand, operates at a relatively high bandwidth for active as well as passive detections. The 3×3-pixel detector module enables target tracking at a relatively high rate by using passive signatures without drastically increasing data bandwidth.

As has been described, the present invention provides an improved IRCM system to heat-seeking missiles.

While the invention has been particularly shown and described with reference to a preferred embodiment, it will be understood by those skilled in the art that various changes in form and detail may be made therein without departing from the spirit and scope of the invention.

What is claimed is:

1. A laser-based infrared countermeasure (IRCM) system comprising:

a set of receive optics for receiving optical information;

a detector for detecting a missile threat from said optical information, wherein said detector is formed by only one single-pixel detector, wherein said single-pixel detector operates at an output bandwidth that allows for both passive and active detection;

a lens module for reflecting said optical information from said receive optics to said detector; and a laser for sending laser beams to any missile threat based on information collected by said detector.

2. The IRCM system of claim 1, wherein said output bandwidth is approximately 45 MHz.

3. The IRCM system of claim 1, wherein said lens module is an off-axis paraboloid lens.

4. The IRCM system of claim 1, wherein said IRCM system further includes an image processor.

5. The IRCM system of claim 4, wherein said image processor provides both passive and active interrogations on said optical information.

6. The IRCM system of claim 1 wherein said output bandwidth is high enough to resolve individual laser pulses with high fidelity.

7. The IRCM system of claim 1 wherein said output bandwidth is at least Nyquist-sampled.

8. The IRCM system of claim 1 wherein said output bandwidth is set so as to maximize compatibility across a wide variety of lasers.

9. The IRCM system of claim 1 further comprising:

a dichroic filter; and wherein said detector comprises a first detector and a second detector, wherein each of said first and second detectors is formed by only one single-pixel detector, wherein said lens module reflects said optical information from said receive optics to said dichroic filter, and wherein said dichroic filter selectively splits said optical information to said first and second detectors.

10. The IRCM system of claim 9, wherein said first detector detects optical information of approximately 2 micron in wavelength.

11. The IRCM system of claim 9, wherein said second detector detects optical information of approximately 4 micron in wavelength.

12. A laser-based infrared countermeasure (IRCM) system comprising:

a set of receive optics for receiving optical information;

a multi-pixel detector module for detecting a missile threat from said optical information, wherein said multi-pixel detector module includes one single-pixel detector surrounded by eight single-pixel detectors, wherein said one single-pixel detector has a higher speed than said eight single-pixel detectors, wherein said multi-pixel detector module operates at an output bandwidth that allows for both passive and active detection;

a lens module for reflecting said optical information from said receive optics to said pixel detector module; and a laser for sending laser beams to any missile threat based on information collected by said multi-pixel detector module.

13. The IRCM system of claim 12, wherein said, one single-pixel detector operates at a bandwidth so as to primarily perform active detection.

14. The IRCM system of claim 12, wherein said eight single-pixel detectors operate at a bandwidth so as to primarily perform passive detection.

15. The IRCM system of claim 12, wherein said output bandwidth is approximately 45 MHz.

16. The IRCM system of claim 12, wherein said lens module is an off-axis paraboloid lens.

17. The IRCM system of claim 12, wherein said IRCM system further includes an image processor.

18. The IRCM system of claim 17, wherein said image processor provides both passive and active interrogations on said optical information.

19. The IRCM system of claim 12 wherein a single-pixel detector-output bandwidth is high enough to resolve individual laser pulses with high fidelity.

20. The IRCM system of claim 12 wherein said single-pixel detector-output bandwidth is at least Nyquist-sampled.

21. The IRCM system of claim 12 wherein said output bandwidth is set so as to maximize compatibility across a wide variety of lasers.

22. The IRCM system of claim 12 further comprising:

a dichroic filter; and wherein said multi-pixel detector module comprises a first multi-pixel detector and a second multi-pixel detector, wherein each of said first and second multi-pixel detectors includes one single-pixel detector surrounded by eight single-pixel detectors, wherein each said one single-pixel detector has a higher speed than said eight single-pixel detectors, wherein said lens module reflects said optical information from said receive optics to said dichroic filter, and wherein said dichroic filter selectively splits said optical information to said first and second multi-pixel detectors.

23. The IRCM system of claim 22 wherein said first multi-pixel detector detects optical information of approximately 2 microns in wavelength.

24. The IRCM system of claim 22 wherein said second multi-pixel detector detects optical information of approximately 4 microns in wavelength.

* * * * *